US007611387B1

(12) United States Patent
Zhang

(10) Patent No.: US 7,611,387 B1
(45) Date of Patent: Nov. 3, 2009

(54) ELECTRICAL CONNECTOR PROVIDED WITH POWER TERMINALS ADAPTED TO CARRY DIFFERENT VOLTAGES

(75) Inventor: George (Huanyl) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,781

(22) Filed: Jun. 12, 2008

(51) Int. Cl.
*H01R 24/00* (2006.01)

(52) U.S. Cl. ..... 439/660; 439/79

(58) Field of Classification Search ..... 439/79, 439/660, 607.01
See application file for complete search history.

(56) References Cited

U.S. PATENT DOCUMENTS 7,255,607 B1 8/2007 Wu et al.
7,318,752 B2 * 1/2008 Fujimoto et al. ..... 439/660
7,371,116 B2 * 5/2008 Chiang ..... 439/607.34
7,517,253 B1 * 4/2009 Chiang ..... 439/660
2007/0218762 A1 * 9/2007 Liao et al. ..... 439/607
2009/0130921 A1 * 5/2009 Chiou ..... 439/722

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector (2) comprises an insulative housing including a mating tongue (20) defining opposite first and second faces (201, 203), a set of standard terminals (21) disposed on the first face (201) and on a middle region thereof, and a plurality of expanded terminals. The expanded terminals at least include a first group of power terminals (23) adapted to carry a first predetermined voltage, and a second group of power terminals (25) adapted to carry a second predetermined voltage. The power terminals within the first and second groups are selectively disposed on the second face (203) of the mating tongue (20) and a remaining region of the first face (201) so as to provide at least two predetermined voltages, both of which are available and in demand by the current customers.

11 Claims, 8 Drawing Sheets

ELECTRICAL CONNECTOR PROVIDED WITH POWER TERMINALS ADAPTED TO CARRY DIFFERENT VOLTAGES

CROSS-REFERENCE TO RELATED APPLICATIONS

This application is related to U.S. patent application Ser. No. 12/157,780 filed on a same date with the instant invention and entitled "ELECTRICAL CONNECTOR WITH POWER CONTACTS DESIGNED TO HANDLE INSTANTANEOUS INRUSH CURRENT", which has a common inventor and assigned to the same assignee with this application.

BACKGROUND OF THE INVENTION

1. Field of the Invention

The present invention generally relates to an electrical connector, and more particularly to an electrical connector with power contacts adapted to carry different voltages for the customer's need.

2. Description of Related Art

Serial ATA connectors in accordance with Serial ATA specification are widely used in desktops currently for transmitting signals from motherboard to HDD or transmitting power from power supply of the computer to the HDD, or transmitting signals or power between outer HDD to the computer. When the Serial ATA connectors used in external applications, current designs usually are single connector comprising signal and grounding contacts for signal transmission or single connector comprising power contacts for voltage power transmission. However, in some applications, the connector transmitting signals needs to be combined with power transmission. Thus, an additional power connector is no longer needed. The actual status is that there is no such a connector complying with such demands.

Related connectors including power contacts can be found in U.S. Pat. No. 7,255,607 issued on Dec. 6, 2007, U.S. patent application Ser. No. 11/893,074 (which has been allowed by Examiner, but not yet issued), U.S. patent application Ser. No. 11/998,771 (which is currently pending before USPTO), all of which are assigned to the same assignee as the current application. All of the above power contacts are adapted to carry a predetermined voltage, such as 3V, 5V or 12V. An electrical connector capable of carrying at least two different predetermined voltages is often required by customers to cater for actual needs.

BRIEF SUMMARY OF THE INVENTION

An electrical connector according to an embodiment of the present invention comprises an insulative housing including a mating tongue defining thereof opposite first and second faces, a set of standard terminals disposed on the first face of said mating tongue and on a middle region thereof, and a plurality of expanded terminals. The expanded terminals at least include a first group of power terminals adapted to carry a first predetermined voltage, and a second group of power terminals adapted to carry a second predetermined voltage different from the first predetermined voltage. The power terminals within the first and second groups are selectively disposed on the second face of the mating tongue and a remaining region of the first face. The above arrangement of power terminals can provide at least two predetermined voltages, both of which are available in the existing industry and in demand by the current customers.

Other objects, advantages and novel features of the invention will become more apparent from the following detailed description of the present embodiment when taken in conjunction with the accompanying drawings.

DETAILED DESCRIPTION OF PREFERRED EMBODIMENTS

Figure 1:
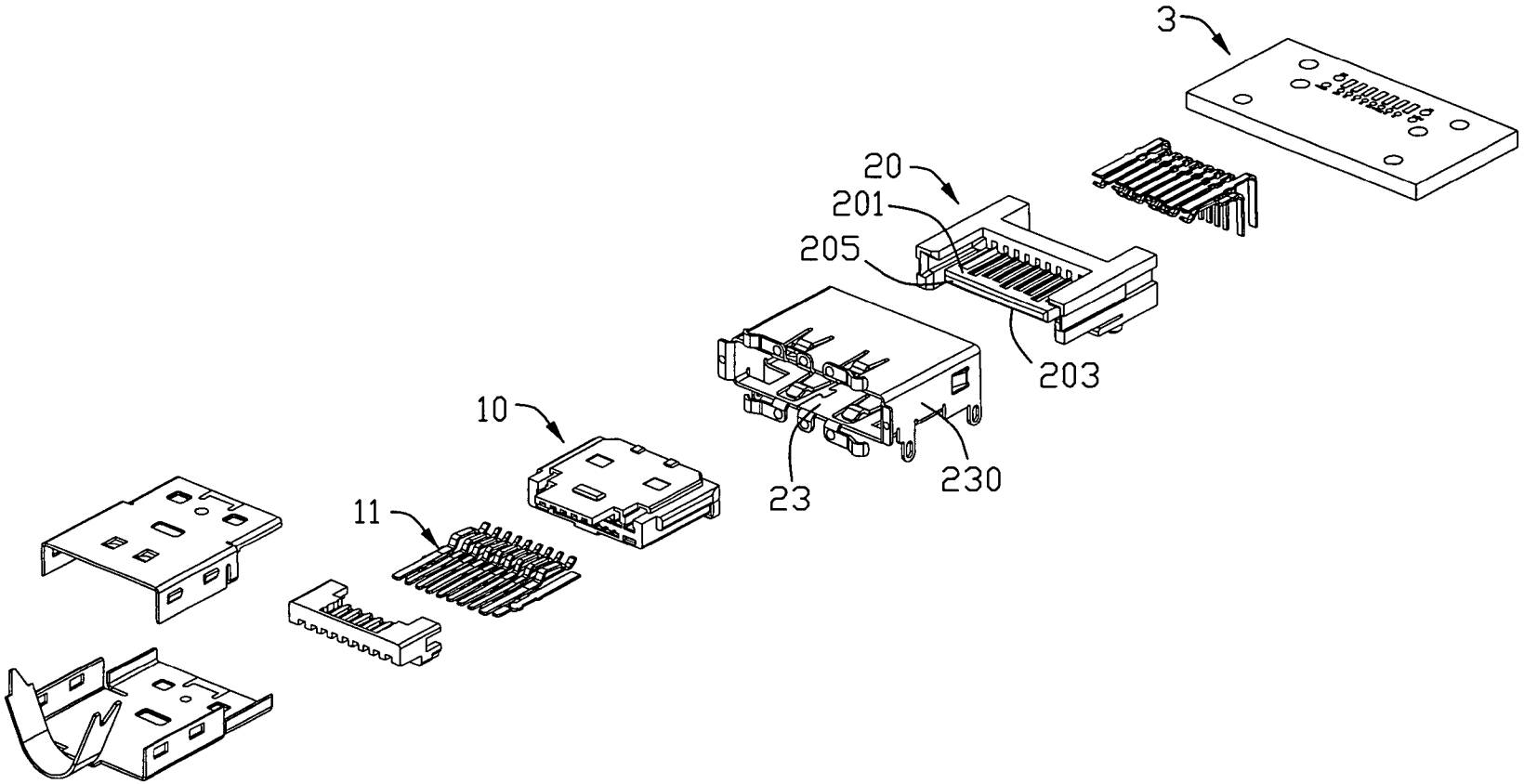
FIG. 1 is an exploded, perspective view of an electrical connector assembly in accordance with a preferred embodiment of the present invention.
Figure 2:
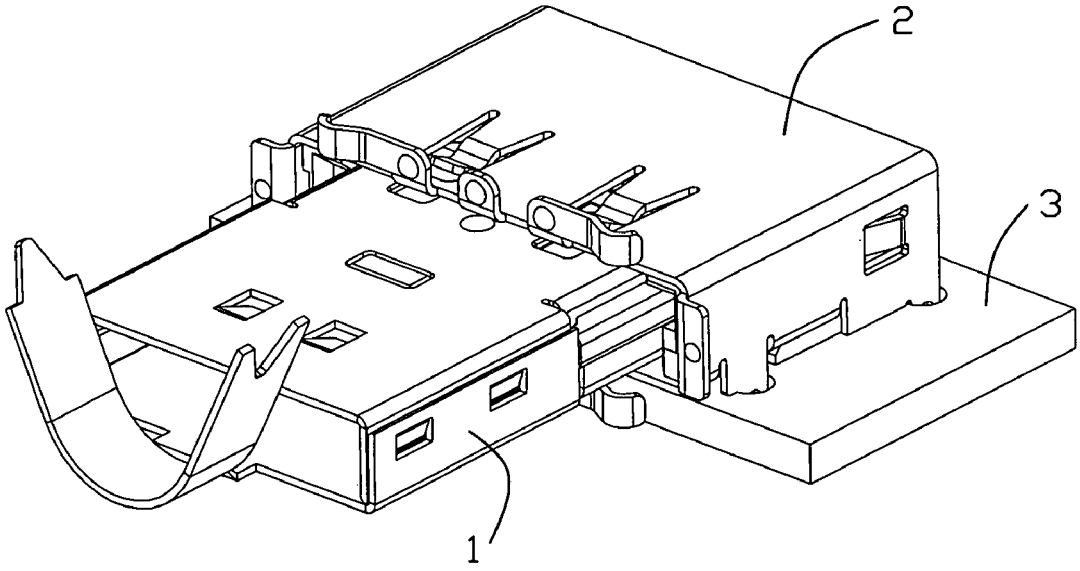
FIG. 2 is an assembled, perspective view of the electrical connector assembly of FIG. 1.
Figure 3:
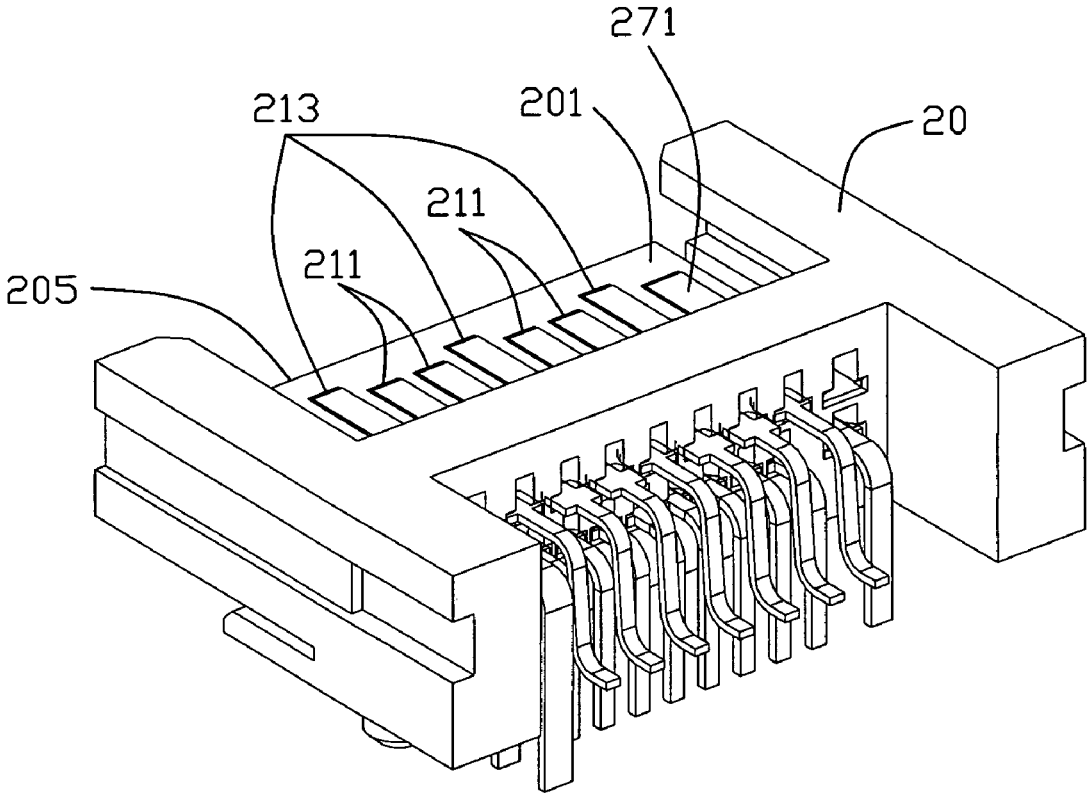
FIG. 3 is a perspective view showing a part of an electrical connector of FIG. 1.
Figure 4:
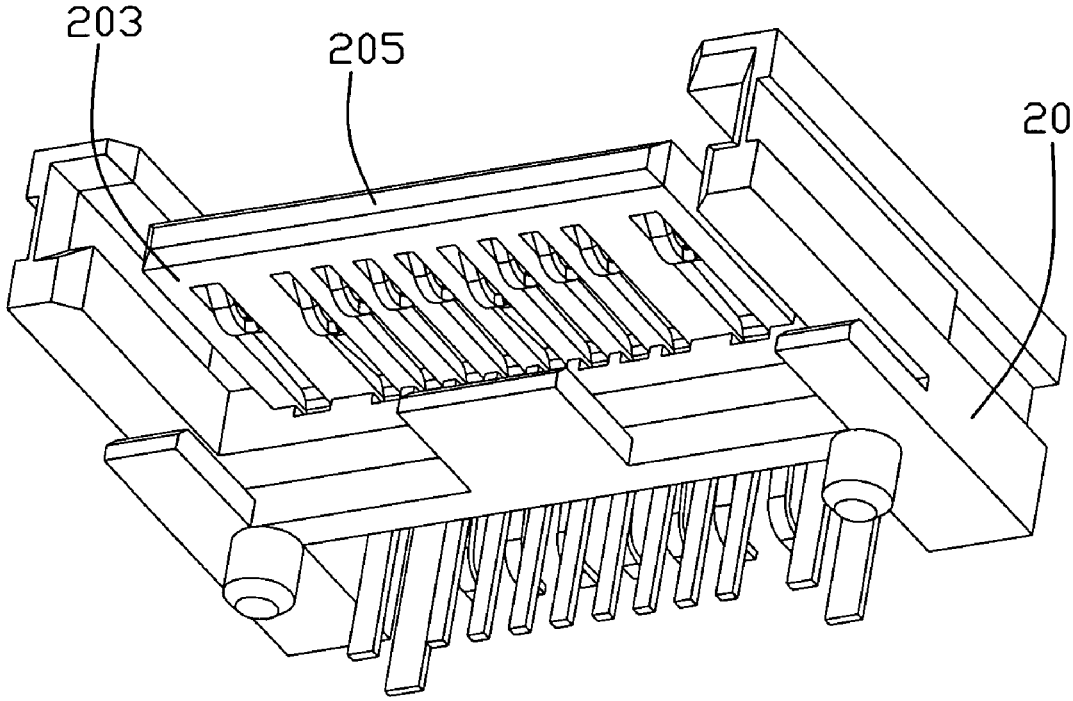
FIG. 4 is a perspective view showing the part of FIG. 3, but viewed from another aspect.

Referring to FIGS. 1-2 in conjunction with FIGS. 3-4, an electrical connector assembly in accordance with a preferred embodiment of the present invention includes a first connector 1 having a base 10 and a plurality of terminals 11 assembled onto the base 10, and a second connector 2 for mating with the first connector 1.

The second connector 2, named as an e-SATA connector, includes the insulative housing having a mating tongue 20 exposed in a mating portion 23 defined by a shell 230 of the second connector 2. The shell 230 of the second e-SATA connector 2 is the same to that of a current SATA connector. The mating tongue 20 defines a first upper face 201, and an opposite second bottom face 203, and a forward face 205.

The second connector 2 includes a set of standard terminals 21 disposed on the upper face 201 of the mating tongue 20 and on a middle region thereof, and a plurality of expanded terminals. The expanded terminals at least include a first group of power terminals 23 adapted to carry a first predetermined voltage, and a second group of power terminals 25 adapted to carry a second predetermined voltage different from the first predetermined voltage, wherein the power terminals within the first and second groups are selectively disposed on the bottom face 203 of the mating tongue 20 and a remaining region of the upper face 201. The first or second predetermined voltage is one value selected from a group comprising 3V, 5V, 12V, all of which are commonly applicable in the existing industry, or a value that may emerge in the further. In this embodiment, the expanded terminals further include a third group of power terminals 27 adapted to carry a third predetermined voltage, which is also one value selected from the group comprising 3V, 5V and 12V.

In this preferred embodiment, the set of standard terminals 21 includes two pairs of signal contacts 211, three ground contacts 213 for the signal contacts 211 to ground, with each pair of signal contacts 211 located between the corresponding two adjacent ground contacts 213. This arrangement of the standard terminals 21 is the same to that of a current SATA connector, which also includes the above-described standard terminals.

Figure 5:
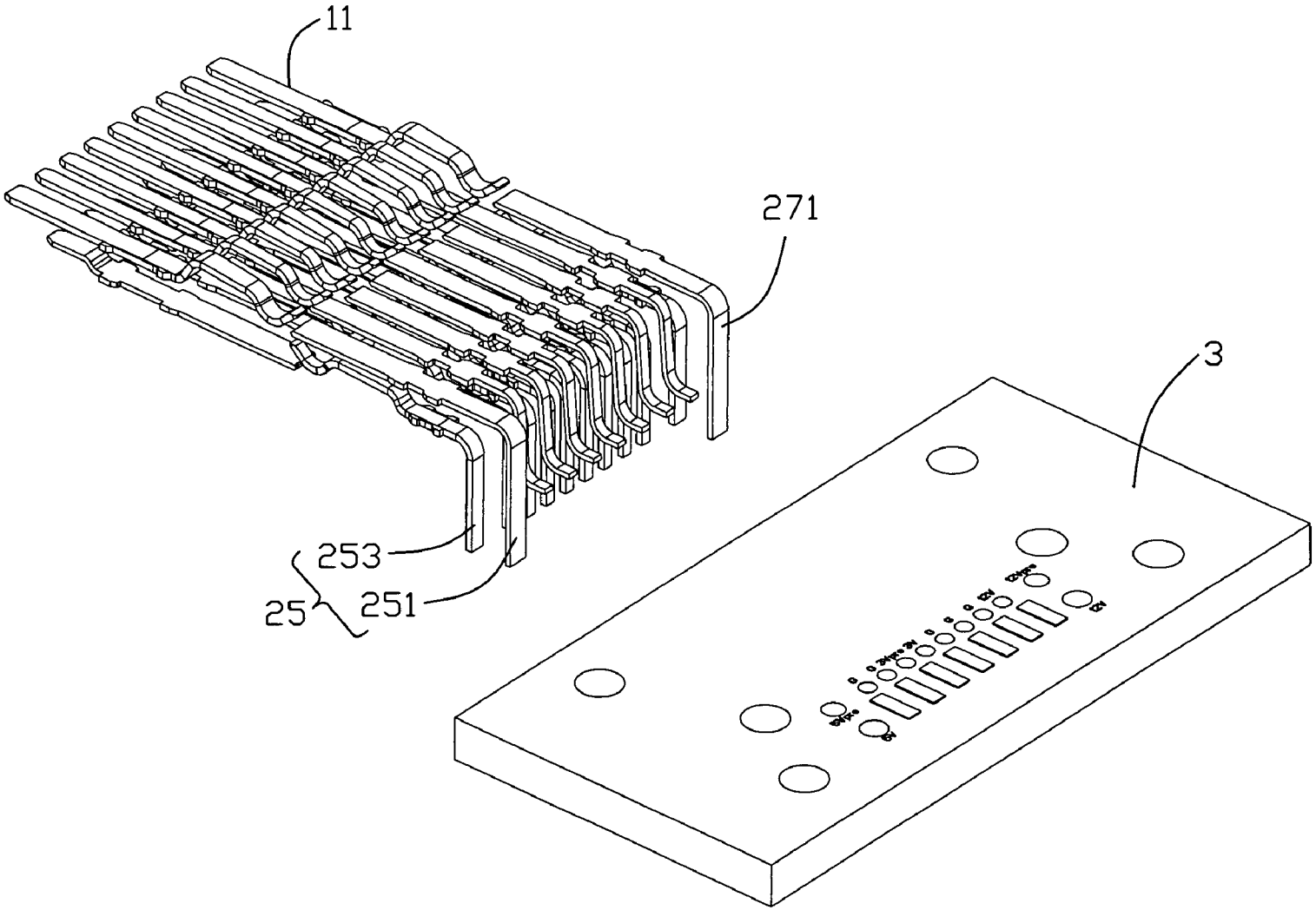
FIG. 5 is a perspective view showing two sets of contacts and a printed circuit board having the designated arrangement of holes, the two sets of contacts being at an initial mating position and respectively belonging to two mated electrical connectors of the electrical connector assembly of FIG. 1.
Figure 6:
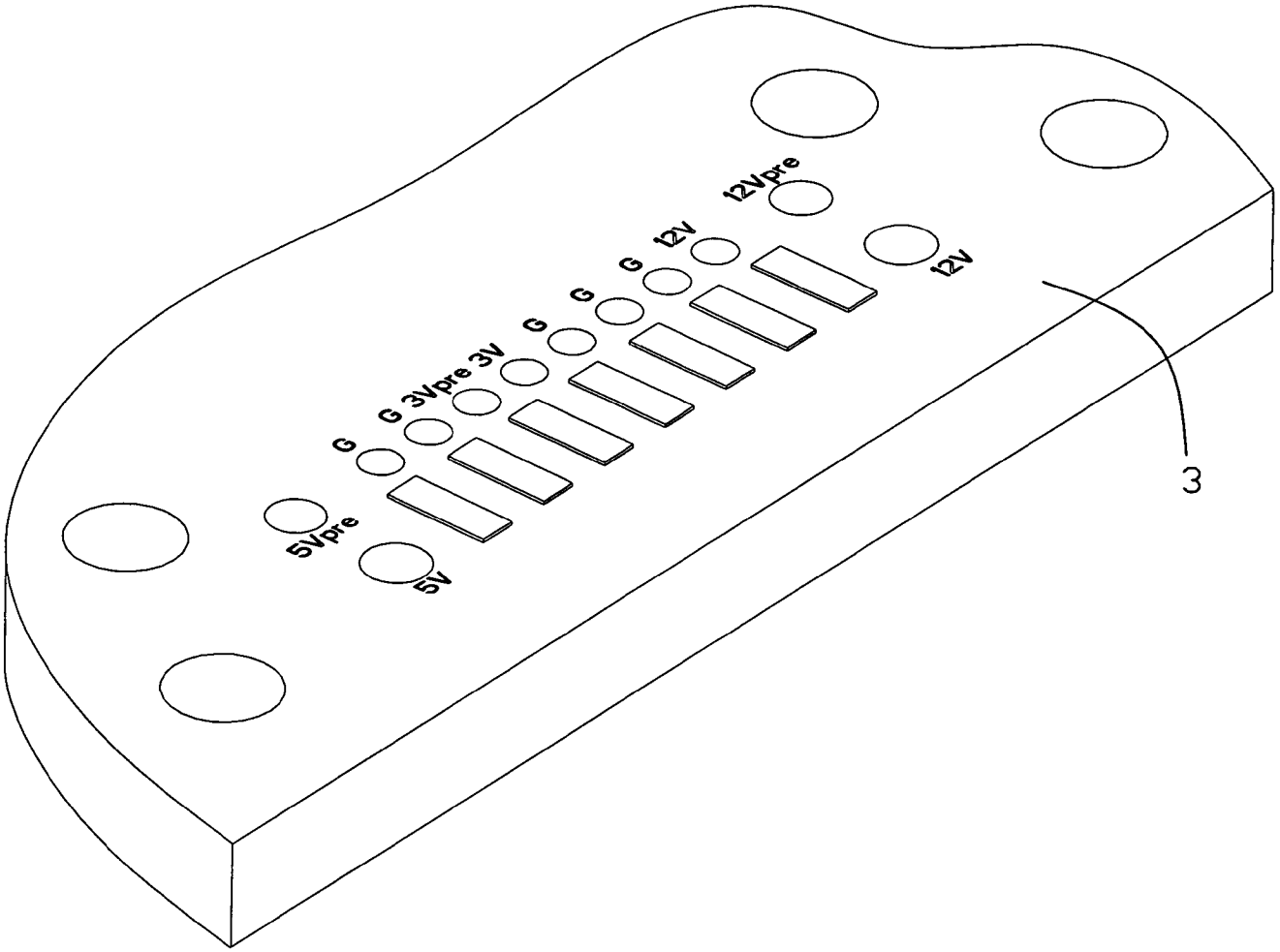
FIG. 6 is an enlarged view of a part of the printed circuit board of FIG. 5, representing designated holes.

As shown in FIGS. 5 and 6, in this preferred embodiment, the expanded terminals include a first group of power terminals 23 adapted to carry 3V voltage and disposed on a plane different from that of the standard terminals 21, i.e., on the bottom face 203 of the mating tongue 20, a second group of power terminals 25 adapted to carry 5V voltage, and a third group of power terminals 27 adapted to carry 12V voltage. The second group 25 and the third group 27 of power terminals are located around opposite side regions of the standard terminals 21, but the power terminals within each group are respective located at different planes, i.e., the upper face 201 and the bottom face 203 of the mating tongue 20. In this embodiment, the first group of power terminals 23 includes two power terminals 231 and 233 both located on the bottom face 203 of the mating tongue 20 different from that plane of the standard terminals 21, with one 233 named as the 3V Pre-charge power terminal, and the other 231 the 3V power terminal. The second group of power terminals 25 includes two power terminals both located at a left side region of the mating tongue 20 but on two different planes, with one 253 named as the 5V Pre-charge power terminal and disposed on the bottom face 203 of the mating tongue 205, and the other 251 named as the 5V power terminal and disposed on the upper face 201 of the mating tongue 20 same to that plane of the standard terminals 21. The third group of power terminals 27 includes three power terminals 271, 273 and 275 located at a right side region of the mating tongue 20 but on two different planes, with one 273 named as the 12V Pre-charge power terminal and disposed on the bottom face 203 of the mating tongue 20, and the other two 271 and 275 named as the 12V power terminals and disposed on the respective upper face 201 and bottom face 203 of the mating tongue 20. On the bottom face 203 of the mating tongue 20 there are a first group of two power ground terminals 22 located between the first group of 3V power terminals 23 and the second group of 5V power terminals 25, and a second group of three power ground terminals 24 located between the first group of 3V power terminals 23 and the third group of 12V power terminals 27. The first group of two power ground terminals 22 is for the first group of 3V power terminals 23 or the second group of 5V power terminals 25 to ground, while the second group of three power ground terminals 24 is for the third group of 12V power terminals 27 to ground.

In order to represent the respective locations of the power terminals with each group, the arrangement of holes in correspondence with the power terminals are shown in FIGS. 5 and 6 in the printed circuit board 3 for receipt of the respective expanded terminals to be designated as "5V, 12V" holes in a front line of the printed circuit board 3, all of which corresponds to the 5V power terminal 251 within the second group 25 and the 12V power terminal 271 with the third group 27; and "5V pre, G, G, 3V prep, 3V, G, G, G, 12V, 12V Pre" holes along a left-to-right direction in a back line of the printed circuit board 3, all of which corresponds to the 5V pre-charge power terminal 253 within the second group 25, the first group of two power ground terminals 22, the 3V pre-charge power terminal 233 and the 3V power terminal 231 with the first group 23, the second group of three power ground terminals 24, and the 12V power terminal 271 and 275 and the 12V pre-charge power terminal 273 with the third group 27. The above arrangement of power terminals can provide three predetermined voltages including 3V, 5V, 12V voltages, all of which are available in the existing industry and in demand by the current customers.

Figure 7:
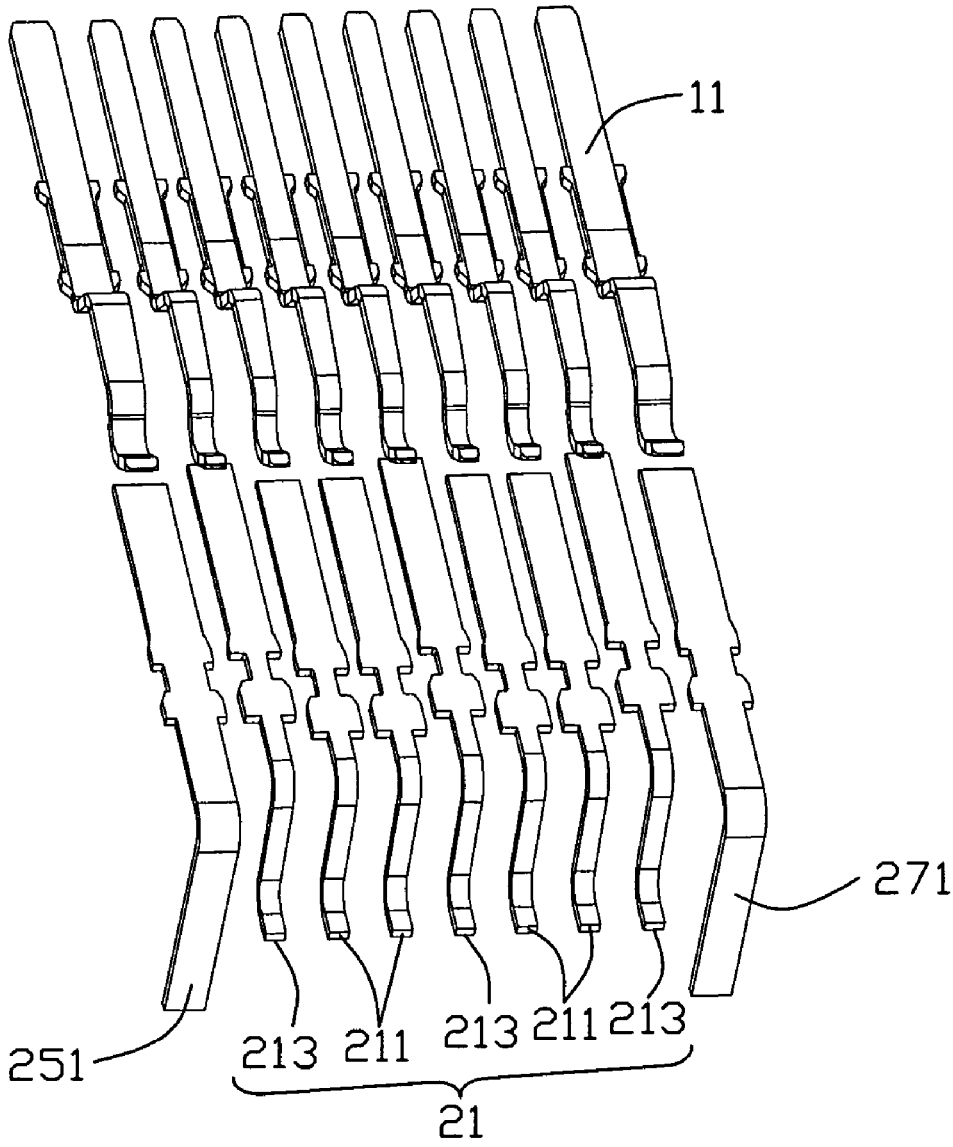
FIG. 7 is a perspective view of an upper plane of the two sets of contacts of FIG. 5, showing an engagement state of the contacts.
Figure 8:
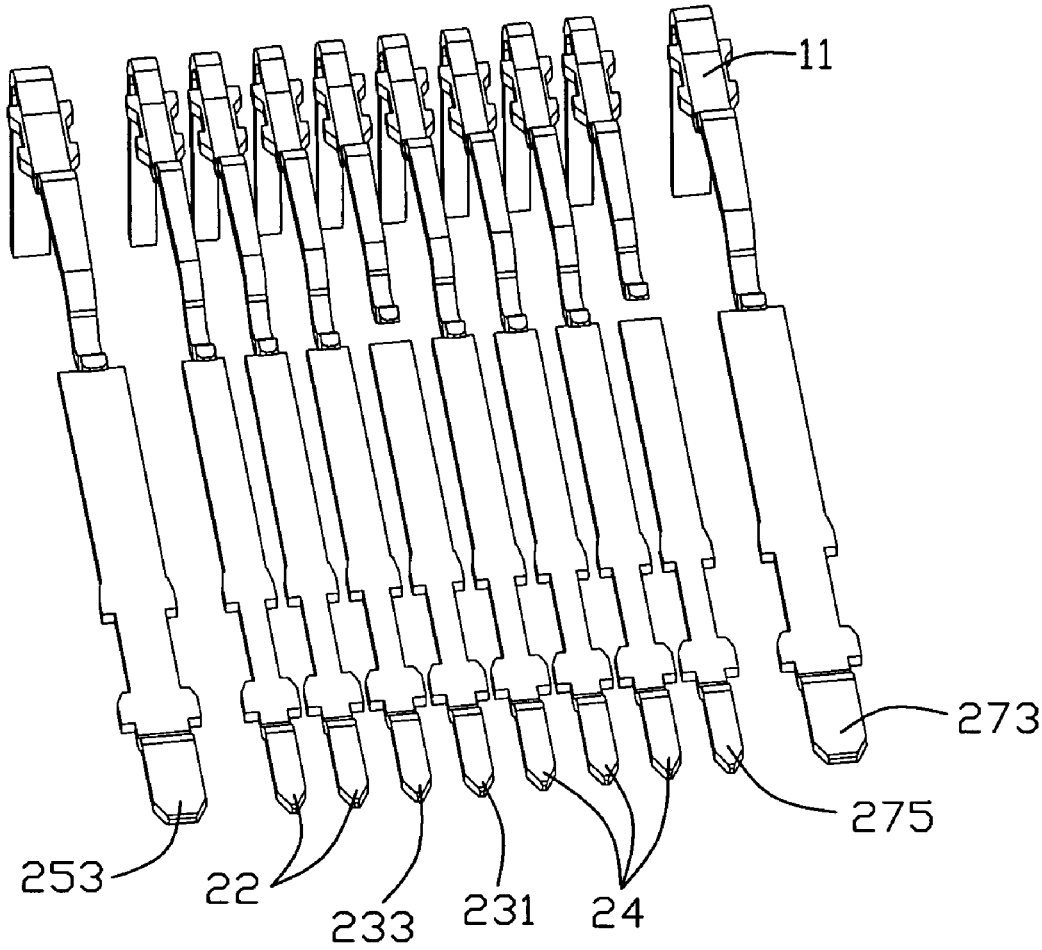
FIG. 8 is a perspective view of a bottom plane of the two sets of contacts of FIG. 5, showing an engagement state of the contacts.

FIG. 7 shows the first upper plane of the terminals of the mated electrical connectors at its initial mating position, with the terminals of the second connector 2 located on the upper face 201 of the mating tongue 20, while FIG. 8 shows the second bottom plane of the terminals of the mated electrical connectors at the same mating position, with the terminals of the second connector 2 located on the bottom face 203 of the mating tongue 20. Referring to FIGS. 3 and 5 in conjunction with FIGS. 7-8, the pre-charge power terminal 233, 253 or 273 within each group is configured to extend much closer to the forward face 205 of the mating tongue 20 than the remainder with that group, such that when the first connector 1 and the second connector 2 mates at an initial position where the pre-charge power terminal 233, 253 or 273 within each group is electrically engaged by a corresponding terminal of the first connector 1 while the remainder within that group is not electrically engaged. At that position, all of the signal ground terminals 213 and the power ground terminals 22 and 24 are also electrically engaged to effect the ground function. The first electrical engagement of the pre-charge power terminal 233, 253 or 273 within each group has the ability to handle the instantaneous inrush current through the pre-charge power terminal. The ground terminals, including the signal ground contacts 213 of the standard terminals 21 and the power ground terminals 22 and 24 of the expanded terminals, are set to take on the respective currents on the signal contacts and the power contacts, which may avoid the current interference from the signal contacts and the power contacts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a mating tongue, said mating tongue defining thereof opposite first and second faces;

a set of standard terminals disposed on the first face of said mating tongue and on a middle region thereof;

a plurality of expanded terminals, at least including:

a first group of power terminals adapted to carry a first predetermined voltage;

a second group of power terminals adapted to carry a second predetermined voltage different from the first predetermined voltage;

wherein the power terminals within said first and second groups are selectively disposed on the second face of said mating tongue and a remaining region of the first face;

wherein said expanded terminals further include a third group of power terminals adapted to carry a third predetermined voltage;

wherein said first, second and third groups of power terminals are adapted to carry a respective one of 3V, 5V, 12V;

wherein each group of power terminals within said first and second groups adapted to carry 3V, 5V includes two power terminals, and said third group adapted to carry 12V includes three power terminals;

wherein three power terminals within said third group are located at a first side region of the mating tongue but on the first and second faces, two power terminals within said second group are located at an opposite second side region of the mating tongue but on the respective first and second faces, two power terminals within said first group are located at the second face of the mating tongue.

2. The electrical connector of claim 1, wherein disposed on the second face of the mating tongue there are two ground terminals between the power terminal of the second group and the power terminals of the first group, and three ground terminals between the power terminals of the first group and the power terminals of the third group.

3. The electrical connector of claim 1, wherein said first, second and third groups of power terminals are spaced with a distance, there are power ground terminals disposed between every adjacent group of power terminals.

4. The electrical connector of claim 1, wherein said mating tongue defines a forward face thereof, at least one of power terminals with each group extending much closer to the forward face of said mating tongue than the other power terminals with each group.

5. The electrical connector of claim 1, wherein the standard terminals includes three signal ground contacts, and two pairs of signal contacts, each pair being located between the corresponding two adjacent signal ground contacts.

6. An electrical connector comprising:

a mating port;

a mating tongue exposed in said mating port;

a set of standard terminals disposed on a same first face of said mating tongue and a middle region thereof;

a plurality of expanded terminals, comprising:

a first group of power terminals adapted to carry a first predetermined voltage; and a second group of power terminals adapted to carry a second predetermined voltage;

wherein at least some power terminals within said first and second groups are located at a second plane different from that of the standard terminals;

wherein said expanded terminals further include a third group of power terminals adapted to carry a third predetermined voltage;

wherein the power terminals within said third group are located at a first side region of the mating tongue but on two different planes, the power terminals within said second group are located at an opposite second side region of the mating tongue but on the two different planes, the power terminals within said first group are located at the second plane;

wherein each group of power terminals is adapted to carry a respective one of 3V, 5V, 12V.

7. The electrical connector of claim 6, wherein said mating tongue defines a forward face thereof, at least one of power terminals with each group extending much closer to the forward face of said mating tongue than the other power terminals within each group.

8. An electrical connector comprising:

a mating port;

a mating tongue exposed in said mating port;

a set of standard terminals disposed on a same face of said mating tongue and a middle region thereof;

a plurality of expanded terminals, comprising:

a first group of power terminals adapted to carry a first predetermined voltage; and a second group of power terminals adapted to carry a second predetermined voltage; wherein said first and second groups of power terminals are located around two opposite side regions of said standard terminals;

wherein said expanded terminals further include a third group of power terminals adapted to carry a third predetermined voltage;

wherein the power terminals within said third group are located at a first side region of the mating tongue but on two different planes including parallel first and second planes, the power terminals within said second group are located at an opposite second side region of the mating tongue but on the first and second planes, the power terminals within said first group are located at the first plane.

9. The electrical connector of claim 8, wherein some power terminals within said first and second groups are located at said same face of the standard terminals, and the other power terminals are located at a plane different from that of the standard terminals.

10. The electrical connector of claim 8, wherein the power contacts in the first group are located at one of said two opposite side regions at first and second levels, the first level being essentially coplanar with said face and the second level not, and the power contacts in the second group are located at the other of said two opposite side regions at said two level.

11. The electrical connector of claim 8, wherein said terminals and said power contacts are categorized with stationary and deflectable forms, which located at the first level all belong to one of the stationary and the deflectable forms while which located at the second level all belong to the other of the stationary and the deflectable forms.

* * * * *